US005875711A

United States Patent [19]

Tateishi et al.

[11] Patent Number: 5,875,711

[45] Date of Patent: Mar. 2, 1999

[54] HEAT SENSITIVE STENCIL HAVING A POROUS SUBSTRATE WITH TIGHTLY BOUND FIBERS

[75] Inventors: Hiroshi Tateishi, Fujinomiya; Masayasu Nonogaki, Numazu, both of Japan

[73] Assignees: Ricoh Company, Ltd., Tokyo; Tohoku Ricoh Co., Ltd., Miyagi-ken, both of Japan

[21] Appl. No.: 949,493

[22] Filed: Oct. 14, 1997

Related U.S. Application Data

[63] Continuation of Ser. No. 508,686, Jul. 28, 1995, abandoned.

[51] Int. Cl.[6] ..... B41N 1/24

[52] U.S. Cl. ..... 101/128.21; 428/195

[58] Field of Search ..... 101/127, 128.21, 101/128.4; 428/195

[56] References Cited

U.S. PATENT DOCUMENTS

| | | | |
|---|---|---|---|
| 5,091,257 | 2/1992 | Nonogaki et al. | 428/411.1 |

FOREIGN PATENT DOCUMENTS

| | | | |
|---|---|---|---|
| 0 583 959 | 2/1994 | European Pat. Off. . | |
| 33196 | 2/1984 | Japan | 101/128.21 |
| 33197 | 2/1984 | Japan | 101/128.21 |
| 180890 | 9/1985 | Japan | 101/128.21 |
| 254396 | 11/1986 | Japan | 101/128.21 |
| 214481 | 8/1989 | Japan | 101/128.21 |
| 14492 | 1/1992 | Japan | 101/128.21 |
| 1 247 552 | 9/1971 | United Kingdom . | |
| 1 250 813 | 10/1971 | United Kingdom . | |
| 1 299 194 | 12/1972 | United Kingdom . | |
| 1 557 518 | 12/1979 | United Kingdom . | |

*Primary Examiner*—Stephen R. Funk

*Attorney, Agent, or Firm*—Oblon, Spivak, McClelland, Maier & Neustadt, P.C.

[57] ABSTRACT

A heat-sensitive stencil is disclosed which includes a porous substrate having opposing first and second surfaces, and a thermoplastic resin film bonded to the first surface of the substrate with an adhesive, wherein the second surface of the substrate is negative to a wax No. 6 pick test defined in the specification herein so that the fibers constituting the substrate are not picked off during its contact with a platen roller in the master forming stage.

4 Claims, No Drawings

HEAT SENSITIVE STENCIL HAVING A POROUS SUBSTRATE WITH TIGHTLY BOUND FIBERS

This application is a Continuation of application Ser. No. 08/508,686, filed Jul. 28, 1995, now abandoned.

BACKGROUND OF THE INVENTION

This invention relates to a stencil for preparing a printing master and, more specifically, to a stencil having a porous substrate on which a thermoplastic resin film is bonded with an adhesive.

A stencil printer capable of performing a series of printing operations including the feeding of a stencil to a master forming section, the cutting of the stencil with a thermal head to form a printing master, the mounting of the master on a drum, the printing of a paper with an ink through the master, and the discharging of the used master is now widely used in various facilities, such as schools and offices, for producing various kinds of printings, because of easiness in handling, low costs and compactness thereof.

The stencil is generally composed of a porous substrate such as a thin paper, a thermoplastic resin film laminated on the substrate with an adhesive and, optionally, an anti-stick layer for preventing the fuse bonding of the thermoplastic film with a thermal head and the blocking of stacked stencils.

The problem with known stencil printers is that thin lines of the printed pattern are apt to be broken and white blanks are often present in the printed solid pattern. Such printing defects are more significant with an increase of the number of the printing masters produced. While extensive studies have been made on both printer parts and stencils, the above problem has not yet been completely solved.

SUMMARY OF THE INVENTION

It is the primary object of the present invention to provide a heat-sensitive stencil in which the foregoing problems have been solved.

In accordance with the present invention, there is provided a heat-sensitive stencil comprising a porous substrate having opposing first and second surfaces, and a thermoplastic resin film bonded to said first surface of said substrate with an adhesive, characterized in that said second surface of said substrate is negative to a wax No. 6 pick test defined in the Specification herein.

It has now been found that the above printing defects are attributed to the accumulation of picked fibers on a platen roller of the master-forming section. During the master-forming stage, the stencil is brought into rolling contact with a platen roller. With the conventional stencil, fibers constituting the substrate are apt to be picked therefrom and the picked fibers deposit and accumulate on the surface of the platen roller. The fiber deposits increase with an increase of the number of the master forming operations. As a result, the thermal cutting operation in the master forming section is not able to be smoothly and satisfactorily carried out when the master forming operations are repeatedly performed.

In the substrate used in the present invention, the fibers are tightly bound to each other. As a consequence, no migration of fibers from the stencil substrate to the platen roller occurs during the master forming stage. Thus, the stencil according to the present invention can give, with good reproducibility, clear printed images free of breakage of thin lines even when the master forming section is used for a long time.

In the present specification and appended claims, the term "negative to a wax No. 6 pick test" is intended to refer to such a characteristic of a substrate that, when the substrate is subjected to a wax No. 6 test, the number of the fibers which have a length of greater 1 mm and which have been picked off and transferred from the substrate to a wax surface is not greater than 1, on average, per 1 $cm^2$ of the wax surface that has been in contact with the substrate.

The wax pick test is described in Japanese Industrial Standard JIS P 8129 and the wax No. 6 pick test herein is defined as follows:

The wax No. 6 test uses pine wax No. 6A which is commercially available from Arakawa Kagaku Kabushiki Kaisha and which is in the form of a bar having a square cross-section of 17 mm×17 mm. The test is performed at a temperature of 20° C. and a relative humidity of 65%. Ten (10) sheets of superimposed woodfree paper (commercially available as Copy Paper Type 6200 from Ricoh Company, Ltd.) are horizontally placed on a flat table and is overlaid with a sample to be tested. A wooden presser having a size of 90 mm×38 mm×6 mm and having a 32 mm diameter circular through-hole is placed on the sample. The tip end portion of the No. 6A wax is gently heated with an alcohol lamp, while slowly rotating about the axis thereof, until a few drops of melted wax fall. The wax whose tip end portion is thus melted is immediately vertically placed on the above sample through the through-hole of the presser with the melted tip end thereof being in contact with the surface of the sample and is pressed against the sample so that 150 g of a load is applied to the sample for 3 seconds. The wax is then allowed to stand with its own weight (40 g) for 15 minutes. Thereafter, the wax is quickly axially pulled in the direction normal to the surface of the sample while pressing the presser against the table to fix the sample. The number of the fibers having a length greater than 1 mm is counted. Similar procedure is repeated for 20 identical samples. An average of the counts of 18 samples is calculated, with the counts of two samples giving the maximum and minimum counts being omitted.

It is preferred that the surface of the substrate on which the thermoplastic resin film is laminated through the adhesive layer be negative to a wax No. 4 pick test. The term "negative to a wax No. 4 test" used herein has the same meaning as the term "negative to a wax No. 6 test" defined above except that a wax No. 4A which is commercially available from Arakawa Kagaku Kabushiki Kaisha and which is in the form of a bar having a square cross-section of 17 mm×17 mm is substituted for the wax No. 6A.

As described previously, in the production of stencils, a thermoplastic resin film is laminated on a porous substrate with an adhesive. The adhesive which is a viscous liquid is applied onto the substrate with a roll coater. During the application of the adhesive, fibers and other constituents of the porous substrate are apt to be picked off therefrom, migrate to the adhesive layer and form aggregates in the adhesive layer. Such aggregates adversely affect the thermal cutting during the master forming stage as well as the passage of the printing ink through the master during the printing stage, causing breakage of thin lines of the printed pattern.

A substrate of a stencil which is negative to the wax No. 4 pick test can withstand the roll coating of the adhesive so that fibers are prevented from being picked off from the substrate during the roll coating stage and, therefore, substantially no aggregates are formed in the adhesive. As a consequence, the stencil according to the present invention can be thermally cut with a thermal head and can give clear printed images free of breakage of thin lines.

Other objects, features and advantages of the present invention will become apparent from the detailed description of the preferred embodiments to follow.

DETAILED DESCRIPTION OF THE PREFERRED EMBODIMENTS OF THE INVENTION

The heat-sensitive stencil according to the present invention includes a porous substrate having opposing first and second surfaces, and a thermoplastic resin film bonded to the first surface of the substrate with an adhesive. The porous substrate may be a thin paper having a thickness of generally 5–70 $\mu$m, preferably 10–55 $\mu$m, and a basis weight of generally 5–15 g/m$^2$ and formed of natural and/or synthetic fibers.

The natural fibers may be, for example, those of wood, cotton, kozo (*Broussonetia kazinoki*), mitsumata (*Edgeworthia papyrifera*), ganpi (*Wikstroemia sikokiana* Fr, et Sav.), a flax plant, Manila hemp, straw and bagasse. Above all, bast fibers such as those of kozo, mitsumata, ganpi, hemp and flax are preferably used for reasons of high wet strengths.

The synthetic fibers including reclaimed fibers may be, for example, polyester fibers, vinylon fibers, acrylic fibers, polyethylene fibers, polypropylene fibers, polyamide fibers and rayon fibers. Above all, polyester fibers and vinylon fibers are preferably used.

The fibers constituting the porous substrate generally has a diameter of 0.1–30 $\mu$m, an average length of 10 mm or less, a fineness of 10 denier or less, preferably 4 denier or less, more preferably 0.5 denier or less, and an aspect ratio of greater than 550.

The porous substrate used in the present invention may be obtained by the following methods.

(1) To increase the entwining of the fibers constituting the substrate. This can be attained by using fibers with a large length, by using curled, synthetic or reclaimed fibers or by using a paper machine of an inclined short net type or of a short net type.

(2) To add a paper strength-increasing agent.

(3) To mix binder fibers, to add a binder or to apply a coating of a binder.

(4) To calender at room temperature or an elevated temperature.

These methods (1)–(4) will be described in more detail below.

The curling of synthetic fibers or reclaimed fibers may be performed by any known manner inclusive of dry and wet methods. In the dry curling method, fibers are mechanically curled by being passed through a pair of gears or by being pressed with a roller in a box. The dry curling method is generally adopted for the treatment of synthetic paper. In the wet curling method, fibers are chemically imparted with strains during the fabrication thereof. The wet curling method is generally adopted for reclaimed fibers. For example, rayon fibers are spun in a weakly acidic bath, drawn at a high temperature in a slightly acidic bath, cut and then curled in water or hot water. The curling may also be effected by spinning a fiber through a specific spinneret using a plurality of raw material liquids.

While a paper machine of a cylinder net type, a long net type, a short net type or an inclined short net type may be used, the last two type paper machines are preferably used for reasons of increased entwining of the fibers.

Examples of paper-strength increasing agents include epoxidized polyamidepolyamine resin, anionic polyacrylamide resin, carboxymethyl cellulose and epichlorohydrin. The paper-strength increasing agent is generally used in an amount of 0.5–5.0 g, preferably 0.5–3.5 g, per one square meter of the paper.

The binder fiber may be, for example, unstretched polyester resin fiber. Examples of binders include an urethane resin and an epoxy resin. By heating with or without pressurization the paper having such a binder fiber or binder, the fibers of the paper are bound together. The binder fiber or binder is generally used in an amount of 2–40% by weight, preferably 5–30% by weight, based on the total weight of the paper.

The calendering is preferably performed at an elevated temperature for reasons of an improved binding force between fibers.

The above methods (1)–(4) may be adopted by themselves or in combination of two or more thereof. For example, when a synthetic fiber is used without being blended with a natural fiber, it is preferred that at least 10% by weight of a binder fiber be incorporated into the synthetic fiber paper and that a calendering treatment be done at a temperature higher than the melting point of the binder fiber. In the case of a mixed fiber containing both natural and synthetic fibers, it is preferred that the mixed fiber paper contain or be applied a coating of at least 10% by weight of a fibrous or non-fibrous fusible resin and that a calendering treatment be done at a temperature sufficient to fuse the resin. It is also preferred that the mixed fiber paper contain at least 10% of a water-swelling resin and be subjected to calendering at room temperature. In the case of a paper composed only of a natural fiber, too, a calendering treatment is suitably combined with an addition of a fusible or water-swelling resin.

The porous substrate having the above-described specific characteristics is overlaid with a thermoplastic resin film. Any conventionally used thermoplastic resin may be used for the purpose of the present invention. Illustrative of suitable thermoplastic resins are polyester resins such as polyethylene terephthalate, polyethylene 1,6-naphthalate, polyethylene $\alpha,\beta$-bis(2-chlorophenoxy)ethane-4,4-dicarboxylate and polycarbonate; polyolefin resins such as polyethylene, polypropylene, ethylenevinyl acetate copolymers, polybutadiene, polystyrene and polymethylpentene; polyamide resins such as polyhexamethylene adipate (nylon 66), poly-$\epsilon$-caprolactam (nylon 6) and nylon 610; halide polymers such as polyvinylidene chloride, polyvinylidene fluoride and polyvinyl fluoride; vinyl polymers such as polyacrylonitrile and polyvinyl alcohol; and other polymers such as polyacetal, polyether sulfone, polyether ketone, polyphenylene ether, polysulfone and polyphenylene sulfide. Mixtures and copolymers of the above polymers may also be used.

It is preferred that the thermoplastic resin film be substantially amorphous or low in degree of crystallinity for reasons of easiness in cutting with a thermal head. The substantially amorphous film is one whose DSC curve is substantially free of a heat absorption peak attributed to the melting of crystals. The degree of crystallinity of the thermoplastic resin film, which can be determined by the X-ray diffraction analysis or DSC method, is preferably 15% or less. Since the thermal energy applied by the thermal head is utilized for cutting the film and is not consumed for melting the resin crystal, the amorphous or low crystalline resin film can be easily and readily cut by the thermal head. Such a film may be obtained by using an amorphous resin as a raw material. A crystalline resin raw material can give a low crystalline film by adopting specific film forming method such as by rapid cooling immediately after extrusion.

The thermoplastic resin film generally has a thickness of 0.1–30 μm, preferably 0.3–10 μm. Generally, the thermoplastic resin film has a melt-starting temperature of 50°–300° C. A film which starts melting at a temperature lower than 50° C. is difficult to be prepared and tends to cause blocking during storage of stencils. Too high a melt starting temperature in excess of 300° C. is undesirable, because the production of a printing master from the stencil by cutting the thermoplastic layer with a thermal head requires much energy. The melt-starting temperature of the thermoplastic resin film is preferably 70°–290° C.

The thermoplastic resin film is laminated on the porous substrate with an adhesive. Any adhesive conventionally used in the field of the stencil preparation may be used for the purpose of the present invention. Illustrative of suitable adhesives are urethane resin adhesives, prepolymer adhesives such as prepolymer of a diisocyanate with a polyether diol, mixed adhesives such as a mixture of an active hydrogen-containing resin with a polyisocyanate, and radiation-curable adhesives curable by irradiation with UV rays or electron beams.

The stencil according to the present invention may be obtained as follows. First, the adhesive is applied on the porous substrate by a roll coating method. The roll coating method may be, for example, multi-roll coating, reverse roll coating, gravure coating, offset gravure coating, kiss coating or rotary screen coating. The coating is generally performed at a temperature of 30°–150° C. At the coating temperature, the adhesive preferably has a viscosity of 200–3,000 cP, more preferably 300–1,500 cP. The adhesive is generally applied in an amount of 0.03–5.0 g/m$^2$, preferably 0.05–1.5 g/m$^2$, more preferably 0.1–1.0 g/m$^2$. It is preferred that the adhesive be applied on that surface of a calendered porous substrate which was brought into contact with a chilled roll during the calendering.

Then, the thermoplastic resin film is placed on the porous substrate with the adhesive layer being interposed therebetween. The laminate is pressed while hardening the adhesive layer.

As described previously, it is desirable to use a porous substrate which is negative to a wax No. 4 test for reasons of preventing the migration of fibers during the roll coating of the adhesive. Since the adhesive applied on one of the opposing surfaces of the porous substrate penetrates into the substrate, the strength of the other surface of the substrate becomes higher than that prior to lamination. Thus, even when a porous substrate which is not negative to a wax No. 6 pick test but is negative to a wax No. 4 test is used as a raw material, it is possible that the surface (on the substrate side) of the stencil obtained therefrom is negative to the wax No. 6 test.

If desired, a stick-preventing layer is provided over the surface of the thermoplastic resin film. Thus, a coating liquid containing a metal salt of a fatty acid, a phosphate surfactant, a lubricant such as a silicone oil, or a fluorocarbon containing a perfluoroalkyl group is applied on the thermoplastic resin film in an amount of 0.001–2 g/m$^2$, preferably 0.005–1 g/m$^2$.

It is preferred that the stencil have antistatic properties. Thus, an antistatic agent such as a metal salt of an organic sulfonic acid, a polyalkyleneoxide, a carboxylic acid salt, a quaternary ammonium salt or an ester of an alkylphosphoric acid is incorporated into the porous substrate, thermoplastic resin film and/or stick preventing layer in an amount of 0.001–2.0 g/m$^2$, preferably 0.005–0.5 g/m$^2$.

The following examples will further illustrate the present invention. Parts are by weight.

EXAMPLE 1

Manila hemp was digested with an alkali cooking liquor, washed and beaten in water to obtain hemp fibers. The hemp fibers (90 parts) were mixed with 10 parts of polyester fibers having a fineness of 0.8 denier, an average length of 5 mm, a curling number of 3.5/cm and a curling degree of 9%. Paper having a basis weight of 11 g/m$^2$ was prepared from the mixture using a Yankee paper machine having a cylindrical net. An aqueous emulsion containing an urethane prepolymer was then applied to the paper by gravure roll coating in an amount of 1.0 g/m$^2$ on solid matter basis. This was subjected to calendering at a calender roll surface temperature of 90° C. and a linear pressure of 6 kg/cm to obtain a thin paper (I) having a thickness of about 35 μm. The wax No. 4 test revealed that the number of picked fibers was 0.83/cm$^2$ on an average of 18 samples. Thus, the paper (I) was found to be negative to the wax No. 4 test.

A polyether-type urethane adhesive at 80° C. (viscosity: 920 cP) was then applied to one side of the paper (I) by a reverse roll coating method in an amount of 0.3 g/m$^2$ on solid matter basis, on which a polyethylene terephthalate film having a thickness of about 1.5 μm was laminated.

A coating liquid containing a mixture of one part of a stick-preventing agent (phosphate surfactant; Gafac RL210 manufactured by Toho Chemical Industries, Ltd.; m.p: 54° C.) with one part of an antistatic agent (dodecyltrimethylammonium chloride; $C_{12}H_{25}N(CH_3)_3Cl$) was then applied by a bar coating method onto the polyethylene terephthalate film in an amount of 0.05 g/m$^2$ on solid matter basis, thereby obtaining a heat sensitive stencil (I) according to the present invention.

The wax No. 6 test was performed for the exposed surface of the substrate of the thus obtained stencil (I), revealing that the number of picked fibers was 0.72/cm$^2$ on an average of 18 samples. Accordingly, the substrate of the stencil (I) was negative to the wax No. 6 test.

The thus obtained stencil (I) was set on a heat sensitive stencil printer (Priport VT-3820 manufactured by Ricoh Company, Ltd.) and a series of printing operations including the preparation of printing masters and the printing of papers using the masters were carried out. Thus, 250 printing masters were prepared from the stencil (I) and 2,000 prints each having thin, one-dot chain line patterns and solid black patterns were produced using each of the first and the last printing masters. It was found that no breakage of the thin line patterns was observed in any of the prints and no white spots or lines were observed in the solid black patterns of any of the prints. Thus, the stencil (I) according to the present invention is excellent in image reproducibility.

EXAMPLE 2

Manila hemp was digested with an alkali cooking liquor, washed and beaten in water to obtain hemp fibers. Paper having a basis weight of 11 g/m$^2$ was prepared from the hemp fibers using a Yankee paper machine having an inclined short length net. An aqueous emulsion containing an urethane prepolymer was then applied to the paper by gravure roll coating in an amount of 1.0 g/m$^2$ on solid matter basis. This was subjected to calendering at a calender roll surface temperature of 90° C. and a linear pressure of 5 kg/cm to obtain a thin paper (II) having a thickness of about 40 μm. The wax No. 4 test revealed that the number of picked fibers was 0.78/cm$^2$ on an average of 18 samples. Thus, the paper (II) was found to be negative to the wax No. 4 test.

Using the paper (II), a stencil was prepared in the same manner as described in Example 1. The wax No. 6 test was performed for the exposed surface of the substrate of the thus obtained stencil (II), revealing that the number of picked fibers was 0.61/cm$^2$ on an average of 18 samples. Accordingly, the substrate of the stencil (II) was negative to the wax No. 6 test. The stencil (II) was subjected to printing tests in the same manner as described in Example 1. It was found that no breakage of the thin line patterns was observed in any of the prints and no white spots or lines were observed in the solid black patterns of any of the prints. Thus, the stencil (II) according to the present invention is excellent in image reproducibility.

EXAMPLE 3

Manila hemp was digested with an alkali cooking liquor, washed and beaten in water to obtain hemp fibers. The hemp fibers (60 parts) were mixed with 20 parts of polyester fibers having a fineness of 0.1 denier and an average length of 4 mm and 20 parts of vinylon fibers having a fineness of 0.3 denier and an average length of 6 mm. Paper having a basis weight of 10 g/m$^2$ was prepared from the mixture using a Yankee paper machine having a cylindrical net. An aqueous viscose solution was then applied to the paper by gravure roll coating in an amount of 3.5 g/m$^2$ on solid matter basis to obtain a thin paper (III) having a thickness of about 38 μm. The wax No. 4 test revealed that the number of picked fibers was 0.67/cm$^2$ on an average of 18 samples. Thus, the paper (III) was found to be negative to the wax No. 4 test.

A toluene solution containing chlorinated polypropylene adhesive at 25° C. (viscosity: 600 cP) was then applied to one side of the paper (III) by a reverse roll coating method in an amount of 0.6 g/m$^2$ on solid matter basis, on which a polyethylene terephthalate film having a thickness of about 1.5 μm was laminated.

A coating liquid containing a mixture of one part of a stick-preventing agent (phosphate surfactant; Gafac RL210 manufactured by Toho Chemical Industries, Ltd.; m.p: 54° C.) with one part of an antistatic agent (dodecyltrimethylammonium chloride; $C_{12}H_{25}N(CH_3)_3Cl$) was then applied by a bar coating method onto the polyethylene terephthalate film in an amount of 0.05 g/m$^2$ on solid matter basis, thereby obtaining a heat sensitive stencil (III) according to the present invention.

The wax No. 6 test was performed for the surface of the substrate of the thus obtained stencil (III), revealing that the number of picked fibers was 0.56/cm$^2$ on an average of 18 samples. Accordingly, the substrate of the stencil (III) was negative to the wax No. 6 test.

The stencil (III) was then tested for the image reproducibility in the same manner as described in Example 1. It was found that no breakage of the thin line patterns was observed in any of the prints and no white spots or lines were observed in the solid black patterns of any of the prints. Thus, the stencil (III) according to the present invention is excellent in image reproducibility.

EXAMPLE 4

Fifty (50) parts of polyethylene terephthalate fibers having a fineness of 0.1 denier and an average length of 3 mm were mixed with 50 parts of low crystalline polyethylene terephthalate fibers having a fineness of 0.2 denier and an average length of 3 mm. Paper having a basis weight of 8 g/m$^2$ was prepared from the mixture using a Yankee paper machine having a short net. This was subjected to calendering at a calender roll surface temperature of 230° C. and a linear pressure of 6 kg/cm to obtain a thin paper (IV) having a thickness of about 23 μm. The wax No. 4 test revealed that the number of picked fibers was 0.5/cm$^2$ on an average of 18 samples. Thus, the paper (VI) was found to be negative to the wax No. 4 test.

A polyether-type urethane adhesive at 80° C. (viscosity: 920 cP) was then applied to one side of the paper (IV) by a reverse roll coating method in an amount of 0.3 g/m$^2$ on solid matter basis, on which a polyethylene terephthalate film having a thickness of about 1.5 μm was laminated.

A coating liquid containing a mixture of one part of a stick-preventing agent (phosphate surfactant; Gafac RL210 manufactured by Toho Chemical Industries, Ltd.; m.p: 54° C.) with one part of an antistatic agent (dodecyltrimethylammonium chloride; $C_{12}H_{25}N(CH_3)_3Cl$) was then applied by a bar coating method onto the polyethylene terephthalate film in an amount of 0.05 g/m$^2$ on solid matter basis, thereby obtaining a heat sensitive stencil (IV) according to the present invention.

The wax No. 6 test was performed for the surface of the substrate of the thus obtained stencil (IV), revealing that the number of picked fibers was 0.44/cm$^2$ on an average of 18 samples. Accordingly, the substrate of the stencil (IV) was negative to the wax No. 6 test.

The stencil (IV) was subjected to printing tests in the same manner as described in Example 1. It was found that the stencil (IV) according to the present invention is excellent in image reproducibility and resistance to repeated printing.

EXAMPLE 5

Manila hemp was digested with an alkali cooking liquor, washed and beaten in water to obtain hemp fibers. The hemp fibers (90 parts) were mixed with 10 parts of polyester fibers having a fineness of 0.8 denier, an average length of 5 mm, a curling number of 3.5/cm and a curling degree of 9%. Paper having a basis weight of 11 g/m$^2$ was prepared from the mixture using a Yankee paper machine having an inclined short net. An aqueous emulsion containing an urethane prepolymer was then applied to the paper by gravure roll coating in an amount of 1.0 g/m$^2$ on solid matter basis. This was subjected to calendering at a calender roll surface temperature of 90° C. and a linear pressure of 6 kg/cm to obtain a thin paper (V) having a thickness of about 35 μm. The wax No. 4 test revealed that the number of picked fibers was 0.66/cm$^2$ on an average of 18 samples. Thus, the paper (V) was found to be negative to the wax No. 4 test.

Using the paper (V), a stencil was prepared in the same manner as described in Example 1. The wax No. 6 test was performed for the surface of the substrate of the thus obtained stencil (V), revealing that the number of picked fibers was 0.61/cm$^2$ on an average of 18 samples. Accordingly, the substrate of the stencil (V) was negative to the wax No. 6 test. The stencil (V) was subjected to printing tests in the same manner as described in Example 1. It was found that no breakage of the thin line patterns was observed in any of the prints and no white spots or lines were observed in the solid black patterns of any of the prints. Thus, the stencil (V) according to the present invention is excellent in image reproducibility and resistance to repeated printing.

EXAMPLE 6

Manila hemp was digested with an alkali cooking liquor, washed and beaten in water to obtain hemp fibers. The hemp fibers (60 parts) were mixed with 20 parts of polyester fibers having a fineness of 0.1 denier and an average length of 4 mm and 20 parts of vinylon fibers having a fineness of 0.3 denier and an average length of 6 mm. Paper having a basis weight of 10 g/m$^2$ was prepared from the mixture using a Yankee paper machine having a short net. An aqueous solution containing viscose was then applied to the paper by gravure roll coating in an amount of 3.5 g/m$^2$ on solid matter basis to obtain a thin paper (VI) having a thickness of about 38 $\mu$m. The wax No. 4 test revealed that the number of picked fibers was 0.50/cm$^2$ on an average of 18 samples. Thus, the paper (VI) was found to be negative to the wax No. 4 test.

Using the paper (VI), a stencil was prepared in the same manner as described in Example 3. The wax No. 6 test was performed for the surface of the substrate of the thus obtained stencil (VI), revealing that the number of picked fibers was 0.44/cm$^2$ on an average of 18 samples. Accordingly, the substrate of the stencil (VI) was negative to the wax No. 6 test. The stencil (VI) was subjected to printing tests in the same manner as described in Example 1. It was found that no breakage of the thin line patterns was observed in any of the prints and no white spots or lines were observed in the solid black patterns of any of the prints. Thus, the stencil (VI) according to the present invention is excellent in image reproducibility and resistance to repeated printing.

EXAMPLE 7

Manila hemp was digested with an alkali cooking liquor, washed and beaten in water to obtain hemp fibers. The hemp fibers (60 parts) were mixed with 20 parts of polyester fibers having a fineness of 0.1 denier and an average length of 4 mm and 20 parts of vinylon fibers having a fineness of 0.3 denier and an average length of 6 mm. Paper having a basis weight of 10 g/m$^2$ was prepared from the mixture using a Yankee paper machine having a short net. An emulsion containing 50 parts of methylmethacrylate, 45 parts of butylmethacrylate and 5 parts of hydroxyethylmethacrylate was then applied to the paper by gravure roll coating in an amount of 1.0 g/m$^2$ on solid matter basis. This was subjected to calendering at a calender roll surface temperature of 90° C. and a linear pressure of 6 kg/cm to obtain a thin paper (VII) having a thickness of about 36 $\mu$m. The wax No. 4 test revealed that the number of picked fibers was 0.61/cm$^2$ on an average of 18 samples. Thus, the paper (VII) was found to be negative to the wax No. 4 test.

Using the paper (VII), a stencil was prepared in the same manner as described in Example 3. The wax No. 6 test was performed for the surface of the substrate of the thus obtained stencil (VII), revealing that the number of picked fibers was 0.56/cm$^2$ on an average of 18 samples. Accordingly, the substrate of the stencil (VII) was negative to the wax No. 6 test. The stencil (VII) was subjected to printing tests in the same manner as described in Example 1. It was found that no breakage of the thin line patterns was observed in any of the prints and no white spots or lines were observed in the solid black patterns of any of the prints. Thus, the stencil (VII) according to the present invention is excellent in image reproducibility and resistance to repeated printing.

EXAMPLE 8

Manila hemp was digested with an alkali cooking liquor, washed and beaten in water to obtain hemp fibers. The hemp fibers (60 parts) were mixed with 20 parts of polyester fibers having a fineness of 0.1 denier and an average length of 4 mm and 20 parts of vinylon fibers having a fineness of 0.3 denier and an average length of 6 mm. Paper having a basis weight of 10 g/m$^2$ was prepared from the mixture using a Yankee paper machine having a short net. A mixed solution containing 70 parts of an epoxydized polyamidepolyamine and 30 parts of carboxymethyl cellulose was then applied to the paper by gravure roll coating in an amount of 1.0 g/m$^2$ on solid matter basis. This was subjected to calendering at a calender roll surface temperature of 90° C. and a linear pressure of 6 kg/cm to obtain a thin paper (VIII) having a thickness of about 37 $\mu$m. The wax No. 4 test revealed that the number of picked fibers was 0.50/cm$^2$ on an average of 18 samples. Thus, the paper (VIII) was found to be negative to the wax No. 4 test.

Using the paper (VIII), a stencil was prepared in the same manner as described in Example 3. The wax No. 6 test was performed for the surface of the substrate of the thus obtained stencil (VIII), revealing that the number of picked fibers was 0.44/cm$^2$ on an average of 18 samples. Accordingly, the substrate of the stencil (VIII) was negative to the wax No. 6 test. The stencil (VIII) was subjected to printing tests in the same manner as described in Example 1. It was found that no breakage of the thin line patterns was observed in any of the prints and no white spots or lines were observed in the solid black patterns of any of the prints. Thus, the stencil (VIII) according to the present invention is excellent in image reproducibility and resistance to repeated printing.

Comparative Example 1

Manila hemp was digested with an alkali cooking liquor, washed and beaten in water to obtain hemp fibers. The hemp fibers (60 parts) were mixed with 40 parts of polyester fibers having a fineness of 0.5 denier and an average length of 3 mm. Paper having a basis weight of 12 g/m$^2$ and a thickness of about 45 $\mu$m was prepared from the mixture using a Yankee paper machine having a cylindrical net. An aqueous emulsion containing an urethane prepolymer was then applied to the paper by gravure roll coating in an amount of 1.0 g/m$^2$ on solid matter basis to obtain a thin paper (IX). The wax No. 4 test revealed that the number of picked fibers was 10/cm$^2$ on an average of 18 samples.

The paper (IX) was processed in the same manner as described in Example 1 to obtain a stencil (IX). The roll which had been used for applying the adhesive on the paper (IX) was found to bear a large amount of fibers which had migrated from the substrate into the adhesive during the roll coating.

The stencil (IX) was tested for the image reproducibility in the same manner as described in Example 1. There were already observed breakage of thin line patterns and white spots in the solid black patterns of the prints obtained using the initially prepared printing master. After the last, 250th printing master had been prepared, the platen roller used for the preparation of the printing masters was checked. It was found that a significant amount of fibers deposited on the surface of the platen roller. The fiber deposits were apparently those which had been picked off from the substrates of the stencils during the preparation of printing masters. As expected, the image reproducibility of the 250th printing master was inferior as compared with that of the first printing master.

Comparative Example 2

The paper (IX) obtained in Comparative Example 1 was processed to obtain a stencil (X). Thus, a toluene solution containing chlorinated polypropylene adhesive at 25° C. (viscosity: 600 cP) was applied to one side of the paper (IX) by a reverse roll coating method in an amount of 0.6 g/m$^2$ on solid matter basis, on which a polyethylene terephthalate film having a thickness of about 1.5 $\mu$m was laminated.

A coating liquid containing a mixture of one part of a stick-preventing agent (phosphate surfactant; Gafac RL210 manufactured by Toho Chemical Industries, Ltd.; m.p: 54° C.) with one part of an antistatic agent (dodecyltrimethylammonium chloride; $C_{12}H_{25}N(CH_3)_3Cl$) was then applied by a bar coating method onto the polyethylene terephthalate film in an amount of 0.05 g/m$^2$ on solid matter basis, thereby obtaining the heat sensitive stencil (X).

The stencil (X) was tested for the image reproducibility in the same manner as described in Example 1. There were already observed breakage of thin line patterns and white spots in the solid black patterns of the prints obtained using the initially prepared printing master. After the last, 250th printing master had been prepared, the platen roller used for the preparation of the printing masters was checked. It was found that a significant amount of fibers deposited on the surface of the platen roller. The fiber deposits were apparently those which had been picked off from the substrates of the stencils during the preparation of printing masters. As expected, the image reproducibility of the 250th printing master was inferior as compared with that of the first printing master.

Comparative Example 3

Manila hemp was digested with an alkali cooking liquor, washed and beaten in water to obtain hemp fibers. The hemp fibers (60 parts) were mixed with 20 parts of polyester fibers having a fineness of 2.3 denier, an average length of 5 mm and 20 parts of viscose rayon fibers having a fineness of 1.5 denier and an average length of 5 mm. To the resulting mixture was blended an aqueous solution of an epoxydized polyamide polyamine resin in an amount of 2% by weight based on the weight of the hemp fibers. Paper having a basis weight of 12 g/m$^2$ and a thickness of 43 $\mu$m was prepared from the blend using a Yankee paper machine having a cylindrical net. An aqueous emulsion containing urethane prepolymer was then applied to the paper by impregnation coating in an amount of 2.5 g/m$^2$ on solid matter basis to obtain a thin paper (XI). The wax No. 4 test revealed that the number of picked fibers was 7/cm$^2$ on an average of 18 samples.

The paper (XI) was then processed in the same manner as described in Example 1 to obtain a stencil (XI). The stencil (XI) was tested for the image reproducibility in the same manner as described in Example 1. There were already observed breakage of thin line patterns and white spots in the solid black patterns of the prints obtained using the initially prepared printing master. After the last, 250th printing master had been prepared, the platen roller used for the preparation of the printing masters was checked. It was found that a significant amount of fibers deposited on the surface of the platen roller. The fiber deposits were apparently those which had been picked off from the substrates of the stencils during the preparation of printing masters. As expected, the image reproducibility of the 250th printing master was inferior as compared with that of the first printing master.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. A heat-sensitive stencil comprising a porous substrate formed of natural and/or synthetic fibers having opposing first and second surfaces, said fibers being tightly bound to each other so that said second surface of said substrate is negative to a wax No. 6 pick test, and a thermoplastic resin film bonded to said first surface of said substrate with an adhesive.

2. A heat-sensitive stencil as claimed in claim 1, wherein said first surface of said substrate is negative to a wax No. 4 pick test.

3. A heat-sensitive stencil according to claim 2, wherein said substrate is a paper having a thickness of 5–70 $\mu$m.

4. A heat-sensitive stencil as claimed in claim 1, wherein said substrate is a paper having a thickness of 5–70 $\mu$m.

* * * * *